United States Patent [19]

Seegers et al.

[11] Patent Number: 4,494,571

[45] Date of Patent: Jan. 22, 1985

[54] ELECTROPNEUMATIC DOOR CONTROL VALVE

[75] Inventors: Gunter Seegers, West Bloomfield, Mich.; Günter Sebesta, Hemmingen; Alfred Klatt, Wathlingen, both of Fed. Rep. of Germany

[73] Assignee: WABCO Fahrzeugbremsen GmbH, Hanover, Fed. Rep. of Germany

[21] Appl. No.: 439,701

[22] Filed: Nov. 8, 1982

[51] Int. Cl.[3] ..... F15B 13/043

[52] U.S. Cl. ..... 137/596.16; 137/595; 91/38; 91/446; 91/459; 91/464; 91/465

[58] Field of Search ..... 137/595, 596.16; 91/38, 91/446, 459, 464, 465; 49/139, 140, 334, 340, 360

[56] References Cited

U.S. PATENT DOCUMENTS

| | | | |
|---|---|---|---|
| 2,619,073 | 11/1952 | Brooks et al. | 91/38 |
| 3,906,838 | 9/1975 | Hofer | 91/459 X |
| 3,921,335 | 11/1975 | Hewitt et al. | 49/360 |
| 4,054,154 | 10/1977 | Mason | 91/459 |
| 4,080,873 | 3/1978 | Bauer et al. | 91/446 |
| 4,339,843 | 7/1982 | Burnett, Jr. | 91/38 X |
| 4,369,696 | 1/1983 | Klatt et al. | 137/596.17 X |

FOREIGN PATENT DOCUMENTS

| | | | |
|---|---|---|---|
| 143287 | 12/1961 | U.S.S.R. | 137/596.16 |

*Primary Examiner*—Gerald A. Michalsky
*Assistant Examiner*—John C. Fox
*Attorney, Agent, or Firm*—G. E. Hawranko

[57] ABSTRACT

An electropneumatic door valve for use with pneumatic door operations as are used on mass transit vehicles. The single valve housing arrangement provides either a through passageway or a throttled passageway for pressurizing the opening or closing chamber of a pneumatic door drive unit. Provisions are also made to allow automatic reversal should the door become wedged, and to allow manual override should that operation be desired. Electrical pulses initiated by the vehicle operator trigger one of two solenoid valves which direct one of two operating pistons into a position to dictate which passageway will be established. Three vent passageways are provided to exhaust compressed air from any of the chambers which had been charged during a previous door operation.

8 Claims, 1 Drawing Figure

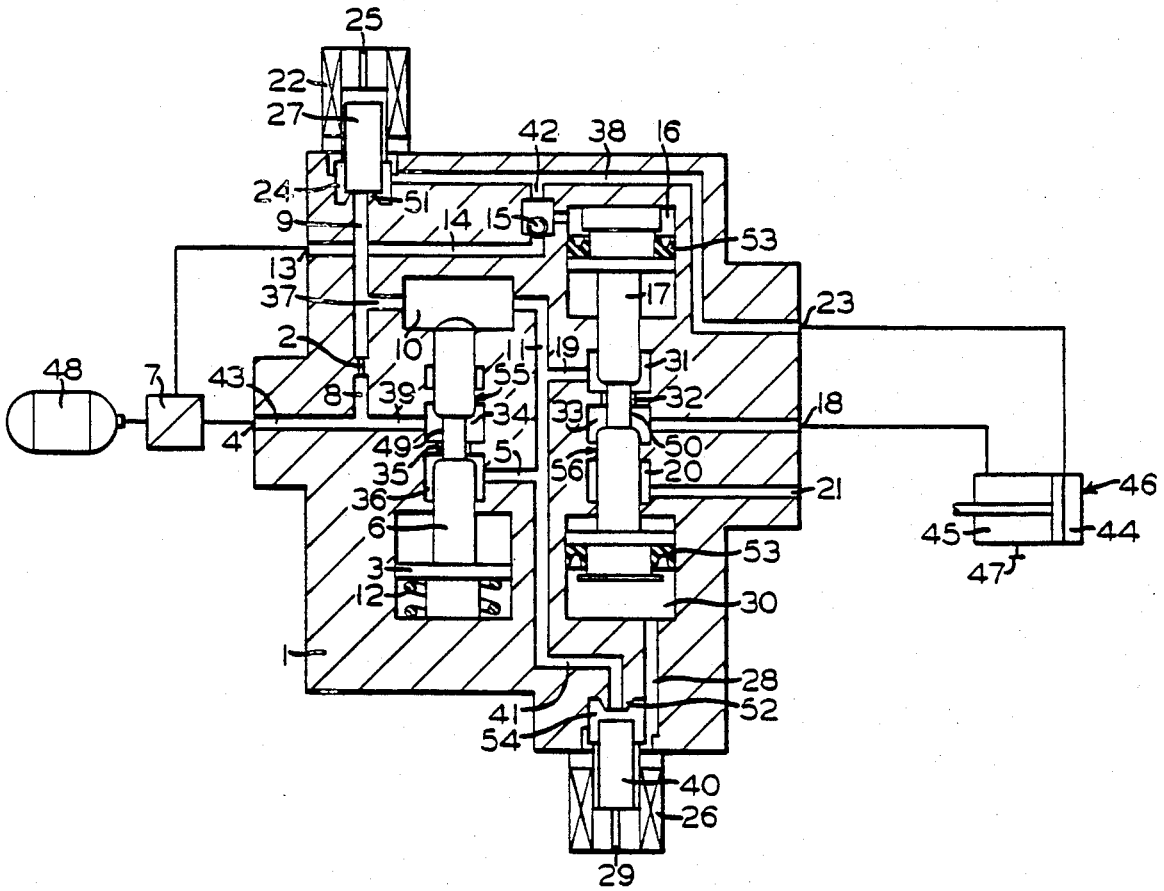
25
22
27
42
38
16
24
51
9
14
15
53
13
37
17
23
2
10
11
19
31
48
7
43
55
8
39
34
32
33
18
4
49
5
50
35
56
20
36
21
46
6
45
44
3
53
47
12
30
1
28
41
52
54
40
26
29

ELECTROPNEUMATIC DOOR CONTROL VALVE

BACKGROUND OF THE INVENTION

The invention relates to an electropneumatic door control valve for the control of pneumatic door drives in pneumatic door operation installations, especially in vehicles which are used for mass transit. Such a door control valve is used to control a pneumatic drive which is designed as a double-acting working cylinder and which consists of two chambers, a door opening chamber and a door closing chamber as well as a piston. The driver of the vehicle triggers an electrical pulse to the door control valve which causes either a pressurization or ventilation of the closing or opening chamber of the door drive, whereupon the stroke motions of the door cylinder piston produce an opening or closing movement of the door. There are various requirements that must be dealt with in such a pneumatic door operation and to date, these requirements have typically been addressed by the use of individual dedicated devices. One such requirement is that the closing movement of the pneumatically operated vehicle door automatically reverse into an opening movement if persons or objects are wedged in the closing door. Another requirement that must be met arises from the situation where it is necessary to vent the door drive so that the door could be opened manually. For this purpose, the supply line of the door control valve is equipped with an emergency cock which, when manually operated, vents the door drive or other pressurized equipment. Because of the use of this emergency cock, a further requirement arises by the fact that there is a danger that after the emergency cock is used, or after it is switched back into the operating position, the door drive will be pressurized suddenly and there will thus be a sudden movement of the door which could damage the door or even injure a person. To deal with this situation, it is necessary that the pressurizing of the door drive take place initially throttled and that the throttling effect can only be overridden by a deliberately triggered electrical pulse.

SUMMARY OF THE INVENTION

The object of the invention, therefore, is to provide a valve apparatus which functions as a door control valve and which incorporates the above-mentioned safety features in a single unit thereby functioning in a simpler manner than would an arrangement of individual valve devices. A door control valve of this type is described in the WABCO-Fahrzeugbremsen European Catalogue-Specification No. 472 017 900 2.

Briefly, the invention consists of a single valve housing with a primary inlet connection and two outlet connections, one leading to the opening chamber, the second leading to the closing chamber of the door drive unit. There is also a venting port for exhausting chamber pressure to atmosphere when necessary. Located within the housing are two operating valves having movable piston spools which, according to their positions, determine whether there will be a free passage for the compressed air or a throttled one and further, whether the compressed air will be directed to the opening chamber or the closing chamber. The electrical pulses triggered by the vehicle driver are connected to two solenoid actuated valves which act both to direct the compressed air to paths which control the movement of the first and second operating valves and also to open passages through which the chamber pressure can be vented. Also included is a double check valve which provides for a second method for controlling the movement of the second operational valve.

BRIEF DESCRIPTION OF THE DRAWING

FIG. 1 is a sectional view of an electropneumatic door control valve constructed in accordance with the invention.

DESCRIPTION AND OPERATION

As shown in FIG. 1, an electropneumatic door control valve embodying the invention consists of a housing 1 which has a primary inlet 4 connected to a compressed air supply 48. Interposed between the primary inlet 4 and the compressed air supply 48, is a pilot valve 7 which directs compressed air to the primary inlet 4 when the emergency cock 47 is closed, or directs the compressed air to the secondary inlet 13 when the emergency cock 47 has been opened. Housing 1 also has two control outlets 18 and 23. The first control outlet 18 communicates with the closing chamber 45, the second control outlet 23 communicates with the opening chamber 44 of the door drive 46. Three vent ports 21, 25 and 29 are included on the housing 1 and function under operating conditions of the door control valve as will be described in a later portion of this specification.

Located within the housing 1 are two operating valves 55 and 56 which are parallel to each other. There are two piston spool elements 6 and 17 which are a part of the two operating valves 55 and 56. The operating state of the two operating valves 55 and 56 determines whether the compressed air will pass from the initial passage 43 to the through passage 39 or the throttled passage 8. The positioning of the two operating valves 55 and 56 also determines whether the compressed air will be directed to the opening chamber 44 or the closing chamber 45 of the door drive 46.

FIG. 1 shows a valve position which results in the pressurization of the closing chamber 45. This first through passageway is made up of initial passage 43, through passage 39, a first series of annular spaces 34, 35 and 36 which surround the first piston spool 6 and are 35 and 36 which surround the first piston spool 6 and are part of the first operating valve 55. As also seen in FIG. 1, annular space 35 is smaller in diameter than annular spaces 34 and 36 and, in fact, substantially corresponds in size to the outer diameter of the first piston spool 6. The first piston spool 6 has a tapered middle segment 49 which, when positioned within the first series of annular spaces 34, 35 and 36, allow the first operating valve 55 to be open. The first through passageway is further made up of passages 5, 11 and 19 and a second series of annular spaces 31, 32 and 33 which surround the second piston spool 17 and are a part of the second operating valve 56. As further shown in FIG. 1, annular space 32 is smaller in diameter than annular spaces 31 and 33 and, in fact, substantially corresponds in size to the outer diameter of the second piston spool 17. The second piston spool 17 has a tapered middle segment 50 which, when positioned within the second series of annular spaces 31, 32 and 33, allow the second operating valve to be open. The outlet of the second operating valve 56 is communicated to the first control outlet 18 which completes the first through passageway.

The second through passageway is established to pressurize the opening chamber 44 of the door drive 46 and is made up of primary inlet 4, initial passage 43, through passage 39, the first series of annular spaces 34, 35 and 36, passages 5 and 11, and the first upper chamber 10 which is located above piston spool 6. The second through passageway is further made up of passages 37 and 9, annular space 24 which is open when solenoid valve member 27 is lifted, passage 38, and finally the second control outlet 23.

The throttled passageways are required as a safety precaution to prevent sudden pressurization of either the opening or closing chamber 44, 45 following a manual operation of the door drive 46 as occurs when the emergency cock 47 is opened. The throttled passageway is formed by primary inlet 4, initial passage 43, throttled passage 8, throttle 2 and at this point, the throttled passageway can branch into one of two directions depending on which solenoid valve 22, 26 is selected. The throttled passageway for the closing chamber 45 continues from the throttle 2 to passage 37, through the first upper chamber 10 which is partially occupied by piston spool 6, passages 11 and 19, the second series of annular spaces 31, 32 and 33 and the first control outlet 18. The throttled passageway to the opening chamber 44 continues from the throttle 2 to the passage 9, the annular space 24, the passage 38 and the second control outlet 23.

Piston spool 6 which partially occupies the first upper chamber 10 during the throttling operation, is tripped by spring 12 acting on spring seat 3 together with the removal of a substantial amount of compressed air from the first upper chamber 10 thus allowing spring 12 to act. Other ways can be used to bias the piston spool 6 against the force of the compressed air in the first upper chamber 10; instead of a spring 12, compressed air can be channeled into the area occupied by the spring 12.

Piston spool 17 is tripped to the through or up position as shown in FIG. 1 by the second solenoid valve 26, 40 which, when activated, lifts the solenoid valve member 40 from its normally seated position thereby establishing a path from passage 5 to the lower chamber 30 via passage 41, space 54, and passage 28.

Piston spool 17 is tripped to the off or down position during pressurization of the opening chamber 44 by establishing a path off of passage 38 to opening 42. When compressed air is present along this path, the double check valve 15 will be open, allowing compressed air to flow to the second upper chamber 16. Sealing element 53 ensures the integrity of chambers 16 and 30 and also serves to maintain piston spool 17 in its last tripped position.

When piston spool 17 is tripped to this off or down position, the pressurizing of the opening chamber 44 results in the need to vent the closing chamber 45. This venting path for the closing chamber 45 is established by the first control outlet 18, annular spaces 20 and 33 and the first vent port 21 which is open to atmosphere. Lower chamber 30 must also be vented when piston 17 is tripped down and this vent path is established by passage 28, the space around solenoid valve element 40 and the third vent port 29.

The path established to vent the opening chamber 44 consists of the second control outlet 23, passage 38, the space around solenoid valve member 27 and the second vent port 25.

There is a secondary inlet 13 to which the compressed air is directed by pilot valve 7 when the emergency cock 47 has been opened. The secondary inlet 13 continues into passage 14, through the double check valve 15 and into the second upper chamber 16 thereby tripping piston spool 17 to the off or down position.

In operation, the door control valve as shown in FIG. 1 acts to pressurize the closing chamber 45 by allowing the compressed air to follow a first through passageway from the primary inlet 4 to the first control outlet 18. It is assumed that the closing operation has resulted from the vehicle operator selecting this operation and thus initiating an electrical pulse to the second solenoid valve 26, 40. The compressed air enters the primary inlet 4, passes through the initial passage 43, through passge 39 and into the first series of annular spaces 34, 35 and 36 which are part of the first operating valve 55 and are open due to piston spool 6 being in the down position From annular space 36, the compressed air flows through passages 5, 11 and 19 and enters the second series of annular spaces 31, 32 and 33 which are part of the second operating valve 56 and are open due to piston spool 17 being in the up or through position. From annular space 33, the compressed air then flows to the first control outlet 18 where it is communicated to the closing chamber 45 of the door drive 46. The compressed air which is present in passages 5 and 11 is simultaneously present at the first upper chamber 10 above piston spool 6 which urges piston spool 6 in the described position against the force of spring 12. Also simultaneous to the pressurizing of the closing chamber 45, the opening chamber 44 is vented, forcing the compressed air back through the second control outlet 23, passage 38, annular space 24 and out through the second vent port 25.

In pressurizing the opening chamber 44, the vehicle operator must trigger a continuous electric pulse to the first solenoid valve means 22, 27 which lifts solenoid valve member 27 off of valve seat 51 thereby establishing the second through passageway from the primary inlet 4 to the second control outlet 23. The compressed air enters the primary inlet 4, passes through the initial passage 43, the through passage 39 and into the first series of annular spaces 34, 35 and 36 which are part of the first operating valve 55 and are open due to piston spool 6 being in the down or through position. From annular space 36, the compressed air flows through passages 5 and 11, the first upper chamber 10, passages 37 and 9 and through annular space 24 around the solenoid valve member 27 to the passage 38 and then on to the second control outlet 23 which communicates with the opening chamber 44 of the door drive 46. Simultaneously, compressed air flows through the opening 42 which branches off from passage 38, through the double check valve 15 and into the second upper chamber 16 where the compressed air acts to urge piston spool 17 to the down or closed position thus also venting lower chamber 30 through passage 28, annular space 54 and vent port 29. With piston spool 17 in this down position, closing chamber 45 is vented back through the first control outlet 18, annular spaces 33 and 20 and the first vent port 21. The vent port 29 is open due to the second solenoid valve 26, 40 being deenergized as occurs during a door opening operation whereby the electrical pulse previously sent to the second solenoid valve 26, 40 is instead sent to the first solenoid valve 22, 27 as a result of the vehicle operator's selection of the opening function.

To close the door again, the vehicle operator pushes a button on a switchboard (not shown) which removes the continuous electrical pulse from the first solenoid valve means 22, 27, allowing solenoid valve member 27 to return to the closed position which further results in opening chamber 44 being vented back through the second vent port 25. Removal of the continuous electrical pulse from the first solenoid valve means results in a retriggering of the continuous electrical pulse to the second solenoid valve means 26, 40 thereby establishing a path to the lower chamber 30. With lower chamber 30 being charged, piston spool 17 is urged back to the up or through position thereby completing the first through passageway to the closing chamber 45.

Connected with the opening and closing chambers 44, 45 are electropneumatic pressure switches (not shown). When a set pressure level is reached corresponding to the open limit position or the closed limit position, the pressure switch interrupts an electrical pulse to the first or second solenoid valve means 22, 27 or 26, 40 so that when the limit position is reached, either the opening or closing chamber 44 or 45 is depressurized.

These electropneumatic pressure switches perform the same function if a person or an object is wedged in the opening or closing door; since, like the limit positions of the door, the pressure in the corresponding door drive chambers 44 or 45 is increased to the point where an electrical pulse sent to the first or second solenoid valve means 22, 27 or 26, 40 is interrupted resulting in a depressurization of either the opening or closing chamber 44 or 45. Further, as a result of this depressurized state, the door can be moved by hand or the door closing movement can be reversed into an opening movement. To restart the door activation equipment, an electrical pulse is simply triggered to one of the two solenoid valve means 22, 27 or 26, 40.

When the emergency cock 47 is opened, the compressed air is cut off from the primary inlet 4 by the pilot valve 7 which then directs the compressed air to the secondary inlet 13. The compressed air then flows through passage 14, through the double check valve 15 and into the second upper chamber 16 where it acts to urge piston spool 17 to the off or down position thereby opening the vent path for closing chamber 45 to exhaust pressure to atmosphere. With compressed air no longer flowing into the first upper chamber 10 due to the primary inlet 4 being depressurized, piston spool 6 is urged to the up, or off, position by the spring 12. Simultaneous to the pressurization of secondary inlet 13, a connecting line (not shown) which runs from the pilot valve 7 to the door control switch (not shown) pneumatically interrupts the circuit to the first solenoid element 22. Opening chamber 44 is thereby also vented back through the second control outlet 23, passage 38, annular space 24 and the second vent port 25.

With the emergency cock 47 now closed, upon repressurization of the primary inlet 4 and simultaneous cutoff to secondary inlet 13, control outlets 23 and 18 leading to the opening and closing chambers 44, 45 respectively, remain depressurized until one of the two solenoid elements 22 or 26 is activated.

If the first solenoid element 22 is selected first, solenoid valve member 27 is lifted which results in closing the second vent port 25. The second control outlet is then pressurized in a throttled manner since the second through passageway is closed by piston spool 6 being in the up position. Piston spool 6 only returns to the down position when pressure in the first upper chamber 10 is built up to the point where it can overcome the force of spring 12. Prior to repressurizing one chamber 44 or 45 after the emergency application has been terminated, the pressure in upper chamber 10 is at a lever higher than atmospheric since upper chamber 10 is not vented to atmosphere, but is effective for controlling the position of piston spool 6 against spring 12 merely by the presence or absence of compressed air from the primary inlet 4.

It should be noted that venting of the opening chamber 44 takes place via the first solenoid valve means 22, 27 and this valve therefore has a greater nominal diameter than the second solenoid valve 26, 40 which merely vents lower chamber 30.

If the second solenoid valve means 26, 40 is selected first, the solenoid valve member 40 moves off of valve seat 52 opening the path to the lower chamber 30 and simultaneously closing the third vent port 29. Lower chamber 30 is gradually pressurized in the initially throttled connection until sufficient pressure is reached to move piston spool 17 into the up or through position thereby opening the second series of annular spaces 31, 32 and 33 communicating to the first control outlet 18.

The first solenoid element 22 is activated and the second solenoid element 26 cut off when opening chamber 44 is pressurized via the second control outlet 23; conversely, the second solenoid element 26 is activated and the first solenoid element 22 put off when closing chamber 45 is pressurized via the first control outlet 18.

Having now described the invention, what we claim as new and desire to secure by Letters Patent, is:

1. An electropneumatic door control valve for controlling a flow of compressed air from a compressed air source to at least one of an opening and closing chamber of a pneumatic door drive where the door drive includes an emergency cock for tripping a pilot valve to divert the compressed air, which comprises:

(a) a housing having a primary inlet and a first and second control outlet;

(b) first and second operating valves located within said housing, each of said operating valves having a first and a second operating position;

(c) a first through passageway formed in said housing between said primary inlet and said first control outlet and including therebetween, said first and second operating valves in respective first operating positions;

(d) a first solenoid valve means for selectively communicating the outlet of said first operating valve to said second control outlet;

(e) a second through passageway formed in said housing between said primary inlet and said second control outlet and including therebetween said first operating valve in such first operating position;

(f) a second solenoid valve means for urging said second operating valve into such first operating position;

(g) a throttled passageway communicating said primary inlet to the outlet of said first operating valve;

(h) a secondary inlet communicating with the pilot valve and being effective when the pilot valve has diverted such compressed air from said primary inlet to said secondary inlet;

(i) a first and second piston spool located in and forming a part of respective said first and second operating valves;

(j) a double check valve for allowing the higher of two pressures between said second through passageway and said secondary operating valve; and (k) a biasing means for urging said first piston spool of said first operating valve into the second operating position.

2. An electropneumatic door control valve as set forth in claim 1, wherein said control valve further includes:

(a) a lower chamber below said second piston spool which, when said second solenoid valve means is open, allows such compressed air to urge said second piston spool into the first operating position;

(b) a first upper chamber above said first piston spool which, when said first operating valve is open, allows such compressed air to urge said first piston spool into the first operating position;

(c) a second upper chamber above said second piston spool which allows such compressed air passing through said double check valve to urge said second piston spool into the second operating position; and (d) said biasing means for urging said first piston spool into the second operating position comprises a spring and a spring seat member.

3. An electropneumatic door control valve as set forth in claim 2 wherein:

(a) said first operating valve comprises a first series of annular spaces and said first piston spool around which said first series of annular spaces are formed;

(b) said second operating valve comprises a second series of annular spaces and said second piston spool around which said second series of annular spaces are formed; and (c) a reduced diameter middle segment formed longitudinally on said first and second piston spools which, when said first and second piston spools are in respective first operating positions, allow said first and second operating valves to be open.

4. An electropneumatic door control valve as set forth in claim 2, wherein said first solenoid valve means includes a solenoid element, a solenoid valve member and a valve seat formed on said housing.

5. An electropneumatic door control valve as set forth in claim 4, wherein said housing further includes a second vent port for venting the opening chamber, said second vent port being in communication with said first solenoid valve means.

6. An electropneumatic door control valve as set forth in claim 2, wherein said second solenoid valve means includes a solenoid valve element, a solenoid valve member and a valve seat formed on said housing.

7. An electropneumatic door control valve as set forth in claim 6, wherein said housing further includes a third vent port for venting said lower chamber, said third vent port being in communication with said second solenoid valve means.

8. An electropneumatic door control valve as set forth in claim 2, wherein said housing further includes a first vent path for venting said closing chamber, said first vent path including a first vent port and an annular space below and in communication with aid second series of annular spaces.

* * * * *

UNITED STATES PATENT AND TRADEMARK OFFICE

CERTIFICATE OF CORRECTION

PATENT NO. : 4,494,571

DATED : January 22, 1985

INVENTOR(S) : Gunter Seegers et al

It is certified that error appears in the above-identified patent and that said Letters Patent are hereby corrected as shown below:

Column 6, line 68, after "secondary", insert --inlet to communicate with said second--

Column 8, line 30, change "aid" to --said--

Signed and Sealed this

*Seventh* Day of *May 1985*

[SEAL]

*Attest:*

DONALD J. QUIGG

*Attesting Officer* *Acting Commissioner of Patents and Trademarks*